US009764928B2

(12) United States Patent
Kupferschmid et al.

(10) Patent No.: US 9,764,928 B2
(45) Date of Patent: Sep. 19, 2017

(54) BIONIC STEP ELEMENT

(71) Applicants: Georg Fischer Automotive (Suzhou) Co., Ltd., Suzhou (CN); Georg Fischer GmbH, Werdohl (DE); Georg Fischer Druckguss GmbH, Herzogenburg (AT); Georg Fischer GmbH & Co KG, Altenmarkt, St. Gallen (AT)

(72) Inventors: Roger Kupferschmid, Hemishofen (CH); Dominik Mahnig, Schaffhausen (CH); Udo Kreutzarek, Singen (DE); Marek Socha, Singen (DE)

(73) Assignees: Georg Fischer Automotive (Suzhou) Co., Ltd. (CN); Georg Fischer GmbH (DE); Georg Fischer Druckguss GmbH (AT); Georg Fischer GmbH & Co KG (AT)

( * ) Notice: Subject to any disclaimer, the term of this patent is extended or adjusted under 35 U.S.C. 154(b) by 0 days.

(21) Appl. No.: 15/378,123

(22) Filed: Dec. 14, 2016

(65) Prior Publication Data

US 2017/0174476 A1 Jun. 22, 2017

(30) Foreign Application Priority Data

Dec. 17, 2015 (EP) ..... 15200747

(51) Int. Cl.
*B66B 23/12* (2006.01)
*B66B 23/08* (2006.01)
(Continued)

(52) U.S. Cl.
CPC ..... *B66B 23/12* (2013.01); *B22D 17/00* (2013.01); *B22D 25/02* (2013.01); *B66B 23/10* (2013.01)

(58) Field of Classification Search
CPC ..... B66B 23/08; B66B 23/12
(Continued)

(56) References Cited

U.S. PATENT DOCUMENTS 2,214,580 A * 9/1940 Dunlop ..... B66B 23/12 198/333
3,986,595 A * 10/1976 Asano ..... B66B 29/02 104/25
(Continued)

FOREIGN PATENT DOCUMENTS

DE 2518440 A1 11/1976
DE 19525827 A1 1/1997
(Continued)

OTHER PUBLICATIONS

European Search Report (in German) issued by the European Patent Office dated Jun. 20, 2016 regarding corresponding EP Application No. 15200747.2 (7 pages).

*Primary Examiner* — Douglas Hess
(74) *Attorney, Agent, or Firm* — Harness, Dickey & Pierce, P.L.C.

(57) ABSTRACT

Step element for an escalator or for a moving walkway, wherein the step element is configured as a one-piece die-cast aluminum part, comprising a step element skeleton and a step plate, wherein the step plate has a step profile, wherein the step profile has webs and grooves running in the travelling direction, wherein the webs are formed by two web arms running practically parallel to one another and by a connecting web face and the grooves run between the webs which are arranged in a row alongside one another.

12 Claims, 4 Drawing Sheets

(51) Int. Cl.
*B66B 23/10* (2006.01)
*B22D 17/00* (2006.01)
*B22D 25/02* (2006.01)

(58) Field of Classification Search
USPC ..... 198/333
See application file for complete search history.

(56) References Cited

U.S. PATENT DOCUMENTS 4,397,383 A * 8/1983 James ..... B66B 23/12 198/333
4,413,719 A * 11/1983 White ..... B66B 23/14 198/333
4,984,672 A * 1/1991 Saito ..... B66B 23/12 198/333
4,984,673 A * 1/1991 Saito ..... B21D 13/10 198/333
5,358,089 A * 10/1994 Riedel ..... B66B 23/12 198/333
5,560,468 A * 10/1996 Inoue ..... B66B 29/02 198/333
5,810,148 A * 9/1998 Schoeneweiss ..... B66B 23/12 198/333
6,039,167 A * 3/2000 Vellinga ..... B66B 23/12 198/333
6,241,071 B1 * 6/2001 Yamashita ..... B66B 23/12 198/333
6,405,847 B1 * 6/2002 Cook ..... B66B 29/04 198/323
6,527,103 B2 * 3/2003 Neszmerak ..... B66B 31/003 198/496
6,978,876 B1 * 12/2005 Tsukahara ..... B66B 23/12 198/333
7,204,361 B2 * 4/2007 Illedits ..... B66B 23/12 198/326
8,511,455 B2 * 8/2013 Gonzalez Alemany ..... B66B 23/12 198/333
9,346,654 B2 * 5/2016 Goldstein ..... B66B 23/02
9,352,937 B2 * 5/2016 Nakagaki ..... B66B 23/12

FOREIGN PATENT DOCUMENTS

EP 1647515 A1 4/2006
EP 2173652 B1 12/2011
GB 1373795 A 11/1974
GB 2216825 A 10/1989

* cited by examiner

BIONIC STEP ELEMENT

CROSS-REFERENCE TO RELATED APPLICATIONS

This application claims the benefit and priority of European Patent Application No. 15 200 747.2 filed Dec. 17, 2015. The entire disclosure of the above application is incorporated herein by reference.

FIELD

The invention relates to a step element for an escalator or moving walkway as well as to a method for the manufacture thereof, wherein the step element is configured as a one-piece die-cast aluminium part, comprising a step element skeleton and a step plate, wherein the step plate has a step profile wherein the step profile comprises webs and grooves running in the travelling direction.

BACKGROUND

Moving systems such as an escalator or a moving walkway have a plurality of step elements connected to one another by a drive chain.

The EP 2 173 652 B1 discloses a step element which is likewise made using the pressurised die-casting process and on which strips are to be mounted. The drawback with this step element is the high weight of the step elements since the webs of the step plate have a solid configuration and run continuously, which also requires a high quantity of material.

The GB 2 216 825 A shows a step which has a step plate made from sheet metal and which as the step profile has a toothed structure in which the teeth are hollow. The skeleton of the step is formed from further individual parts which have to be fitted together which requires a lot of time which is not commercially viable with such a high number of steps required for escalators.

SUMMARY

It is an aspect of the invention to provide a step element and a method connected therewith which requires less material for manufacturing a step element and which thus results in a weight reduction. Material costs are also to be reduced and assembly work dispensed with in order to ensure an economic production of a step element. It should furthermore be taken into consideration that the step surface has a non-slip structure.

This is achieved according to the invention in that the webs are formed by two web arms running practically parallel to one another and by a connecting web face, and the grooves run between the adjoining rows of webs, or in that recesses are arranged in the step plate at right angles to the webs and grooves.

The step element according to the invention can be used for an escalator or for a moving walkway. The step element skeleton is to be configured according to the field of use. This means that if the step element is used for an escalator it is configured differently than one used for moving walkways since the latter only move horizontally compared with escalators where the step elements are displaced horizontally and vertically. The present invention is however to be used for both types of moving systems. The step element skeleton is comprised of ribs and longitudinal and transverse girders wherein the structure is adapted specifically to the requirements of the moving walkways or escalators.

The step plate is connected in one piece to the step element skeleton. This means that the step element is made as a die-cast aluminium part which avoids high assembly costs.

The step element has a step profile which comprises webs and grooves running in parallel. The webs and grooves run in the travelling direction of the step elements. In order to produce the step elements and step plate in the best possible cost-effective manner, the step profile is configured so that as little material as possible is required but the step plate still has the required strength and stability. The webs are formed for this purpose by two web arms running practically parallel wherein the web arms of one web are connected to one another via the web surface. One web is followed correspondingly by one groove, seen transversely to the travelling direction, which defines the distance to the next web. A type of toothed step profile is thereby formed wherein the step element, seen from the underneath of the step element, has a hollow configuration, and the webs have a web cavity. The contiguous web faces when placed against each other in rows form the step surface.

The web arms of one web run practically parallel to one another wherein a slight incline of the web arms relative to one another exists in order to ensure the step element can be removed from the mould, with the web arms of one web preferably including an angle of 0-6°.

It is advantageous if the web arms of one web connected to the web face are arranged so that they form a web cavity in the web. This means that the wider the web arms are spaced apart from one another so the greater is the web cavity formed wherein the step profile, and the webs and grooves with the associated web arms, web faces and groove bases, are made with the thinnest possible walls and the wall thickness is the thinnest possible. As previously already mentioned the web is open at the bottom, that is, seen from the underneath of the step plate the webs form a series of longitudinally aligned indentations adjacent one another.

The grooves are formed through the spacing of the webs relative to one another wherein the web arms are connected to one another via the groove base and thus have a continuous step profile.

The wall thickness of the step profile which is formed from the continuous run of web, groove, web etc., preferably runs constant and has the same wall thickness overall, which optimizes the casting process and ensures a good casting quality of the step element.

The web face of one web preferably runs practically at right angles to the two web arms of the web. It is particularly preferred if the angle between the web face and the web arm lies in the region of 90-93°, as a result of pulling on the web arms for removing the step element from the mould.

The web width as well as also the groove width are to be selected individually according to the requirements for the step element and can also be arranged differently over the width of the step plate. By way of example the webs can lie closer together in the middle of the step plate and thus form narrower groove widths, but other arrangements of the webs and grooves are also possible, such as also a regular spacing of the webs and grooves which is constant over the width of the step plate. It is important that the grooves and webs remain the same width over their longitudinal path. Standard specifications for a maximum web and groove width are to be observed. This standardization is set up for technical safety reasons. The web widths are preferably smaller or narrower or the same as the groove widths.

A preferred configuration of a step plate has also shown that recesses can be arranged at right angles to the path of the webs and grooves. The arrangement of recesses in the step profile allows a further reduction in materials. A corresponding standard also has to be taken into account here regarding the width of the recess and spacing of the recesses relative to one another, which corresponds to the width of the teeth thereby formed from the web.

The recesses are preferably the same width as or narrower than a tooth, wherein the width of a tooth is defined by the spacing of the recesses relative to one another.

According to an embodiment of the invention it is also achieved in that recesses are arranged in the step plate, which has webs and grooves running in the travelling direction, at right angles to the path thereof. This configuration of the step plate likewise allows a reduction in the material and increases the commercial viability and in addition the recesses provide a non-slip step surface.

Also in this embodiment the webs, which are configured as just vertical ribs, can be spaced out differently over the width of the step plate, as well as a constant regular spacing also being possible.

Teeth are formed from the webs through the arrangement of recesses running at right angles to the webs and grooves in the step plate. The width of the teeth is defined corresponding to the spacing of the recesses relative to one another.

Also here the recesses are preferably configured the same width as or narrower than the teeth which are formed between the recesses. The arrangement and distribution of the recesses as well as the width of the individual recesses can be regular as well as also irregular over the step plate.

It has also been seen that the bottom of the recess, preferably configured as a radius, optimises the flow behaviour of the material.

It has proved particularly advantageous that the recess width corresponds to double the radius, or the bottom of the groove is formed as a continuous radius or semi-circle.

The task of producing a step element according to the invention which is formed in one piece is carried out by means of the die-casting method.

DRAWINGS

An exemplary embodiment of the invention will now be described with reference to the figures wherein the invention is not restricted only to the exemplary embodiment, more especially not to only a step element of an escalator but also a step element of a moving walkway. In the drawings.

DETAILED DESCRIPTION

Figure 1:
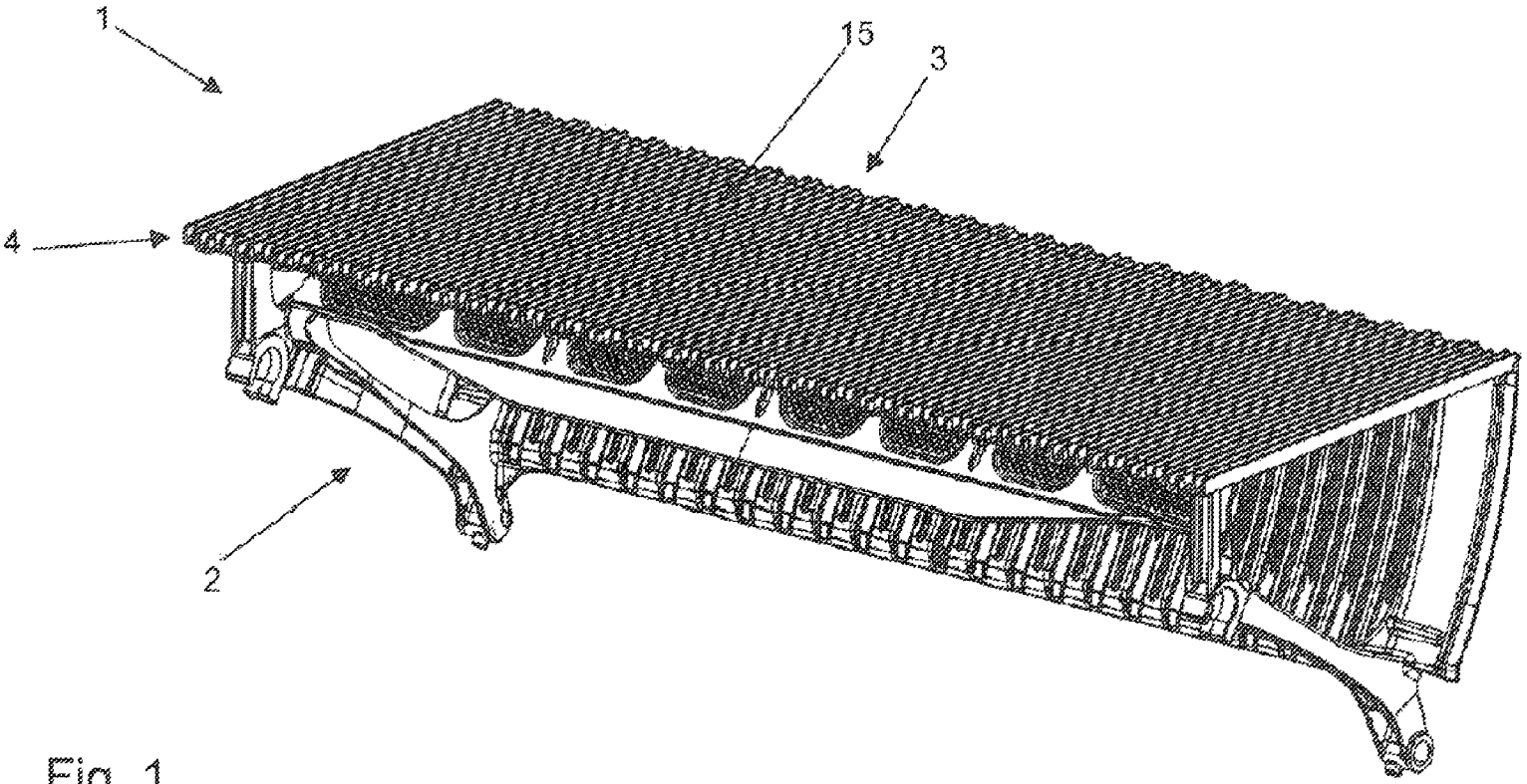
FIG. 1 shows a three-dimensional view of a step element for an escalator.

FIG. 1 shows a three-dimensional view of a step element 1 for escalators. The invention can however equally be applied to step elements for moving walkways even where these are not shown in the drawings.

The step element 1 is configured as a one-piece die-cast aluminium part whereby expensive assembly processes for the step element 1 can be avoided. The step element 1 comprises a step element skeleton 2 which is preferably formed from longitudinal and transverse girders as well as from ribs. The step element skeleton 2 is configured according to the required use. Step elements 1 for moving walkways as well as also for escalators comprise a step element skeleton 2 of this kind wherein the task of the skeleton 2 lies in forming a moving system through sufficiently rigid step elements 1 or step element skeletons 2 which are fastened on the drive chain and arranged in a row alongside each other. Whereby all the step element skeletons 2 have to fulfil the same task and the exact path and the exact arrangement of the longitudinal and transverse girders and also the ribs are not the prime concern, which is why they are not specifically dealt with here.

The step element 1 comprises a step plate 3 which is configured with the step element skeleton 2 as a die-cast aluminium part. The step plate 3 has a step profile 4 on which the person being moved stands, or stands on the step surface 15 of the step profile 4. The step profile 4 is formed by the webs 5 which are placed in a row alongside one another but spaced from one another, which is clearly visible in FIGS. 2-7. In order to configure the step element 1 as economically as possible in production, as little material as possible is used, wherein however the prescribed loads have to be withstood.

FIGS. 2 to 5 show a possible embodiment of a step profile 4 in which the webs have web cavities 9.

This means that the web 5 is formed by two web arms 7 running approximately parallel to one another and connected to one another via the web face 8 wherein the web faces 8 which are spaced from one another and arranged in a row alongside each other form the step surface 15. In order to ensure the step element 1 can be removed from the mould the webs 5 or web arms 7 preferably have a slight incline. The web arms 7 of a web 5 preferably include an angle $\alpha$ of 0-6°, which in turn produces the approximately right-angled path of the web face 8 relative to the web arms 7.

The angle $\beta$ included between the web arms 7 and the web face 8 preferably amounts to 90-93°. Grooves 6 are formed between the webs 5, these grooves preferably being of equal width to or narrower than the web width 13.

Figure 2:
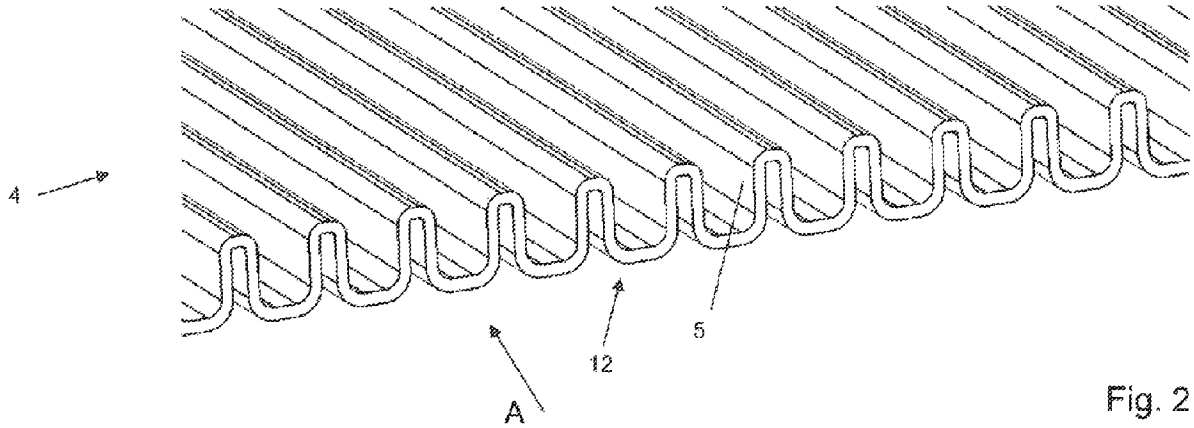
FIG. 2 shows a three-dimensional section of a step profile of a step element according to the invention.
Figure 3:
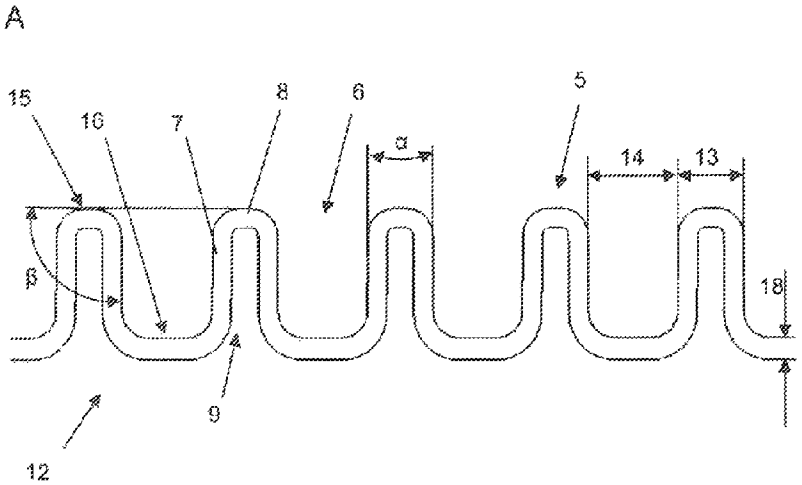
FIG. 3 shows a two-dimensional section of a step profile of a step element according to the invention.

The webs 5 or web arms 7 of the individual webs 5 are connected to one another via the bottom 16 of the grooves, which forms the step profile 4 which is clearly apparent in FIG. 2. The step profile 4 preferably has a continuous constant wall thickness 18. The corners in the step profile 4 are preferably formed by radii which favours the flow behaviour of the material.

Figure 4:
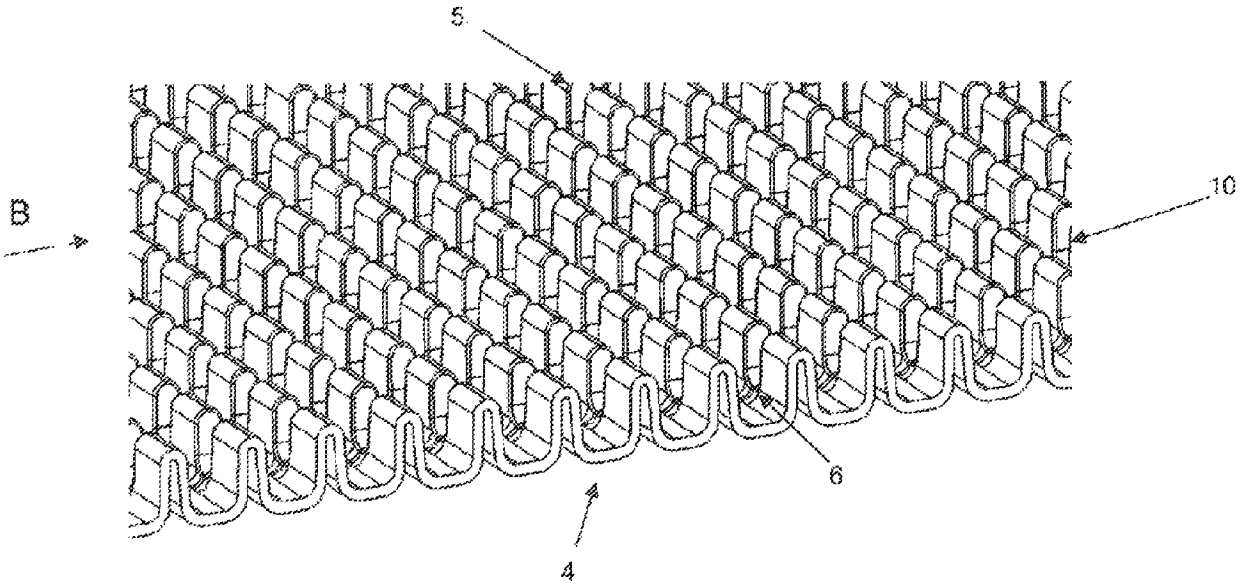
FIG. 4 shows a three-dimensional section of a step profile with recesses of a step element according to the invention.
Figure 5:
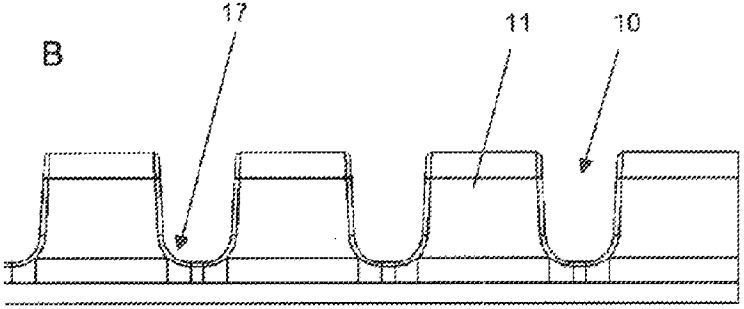
FIG. 5 shows a two-dimensional section of a step profile with recesses of a step element according to the invention.

FIGS. 4 and 5 show a further configuration of a step profile 4 in which recesses 10 run at right angles to the webs 5 and grooves 6 towards the webs 5 and grooves 6. Wherein the width of the recesses 10 is the same as or narrower than the width of the teeth which are formed by the spacing of the recesses 10 relative to one another.

Figure 6:
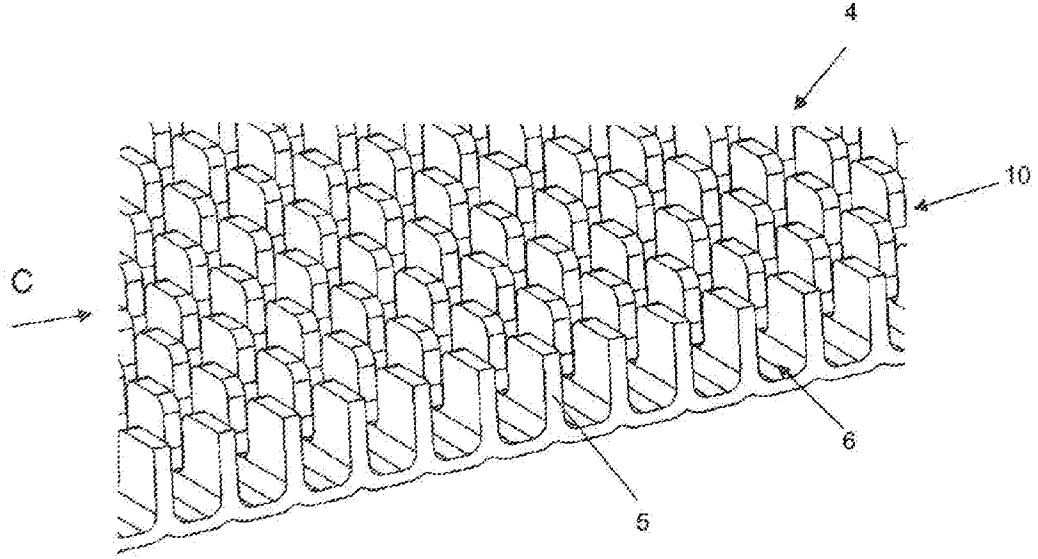
FIG. 6 shows a three-dimensional section of a step profile with recesses of a step element according to the invention.
Figure 7:
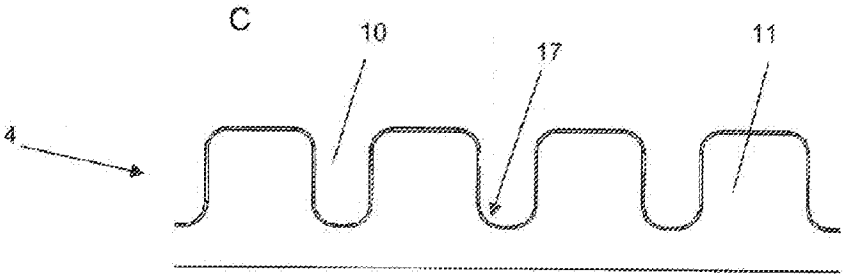
FIG. 7 shows a two-dimensional section of a step profile with recesses of a step element according to the invention.

FIGS. 6 and 7 show a further configuration of the step profile 4. The webs 5 are formed by simple ribs which are spaced from one another and thus form the grooves 6. In order now to undertake the task of improving the commercial viability by saving material, recesses 10 running at right angles to the webs 5 and grooves 6 are arranged in the step plate 3. Through the spacing of the recesses 10 relative to one another teeth 11 are formed in the webs 5 wherein the width of one tooth is wider than or equal to the width of one recess 10. In order to ensure optimum flow of the material or liquid aluminium the bottom 17 of the recesses 10 is configured as a radius. The width of the recess 10 preferably corresponds to double the radius or to the diameter of the semi-circle or half shell which serves as the bottom 17 of the recess.

REFERENCE NUMERAL LIST

1 Step element
2 Step element skeleton
3 Step plate
4 Step profile
5 Web
6 Groove
7 Web arm
8 Web face
9 Web cavity
10 Recess
11 Tooth
12 Underneath side step plate
13 Web width
14 Groove width
15 Step surface
16 Bottom of groove
17 Bottom of recess
18 Wall thickness
α Included angle of web arms
β Included angle between web arm and web surface

What is claimed is:

1. A step element for an escalator or for a moving walkway, wherein the step element is configured as a one-piece die-cast aluminium part, comprising a step element skeleton and a step plate wherein the step plate has a step profile, wherein the step profile has webs and grooves running in the travelling direction, wherein the webs are formed by two spaced apart web arms running substantially parallel to one another and by a web face running transverse to the web arms and connecting the two spaced apart web arms, and wherein the grooves run between the webs and are arranged in rows alongside one another.

2. The step element according to claim 1 wherein, the web arms of one web include an angle (α) of 0-6°.

3. The step element according to claim 1 wherein, the web has a web cavity wherein the web cavity is formed by the web arms and the web face.

4. The step element according to claim 1 wherein, the web faces form the step surface wherein the web faces are arranged at practically right angles (β) to the web arms, wherein the internal angle (β) between the web arms and web face is preferably between 90-93°.

5. The step element according to claim 1 wherein, the web width is less than or equal to the groove width.

6. The step element according to claim 1 wherein, the step profile has a wall thickness which runs constantly at the same thickness.

7. The step element according to claim 1 wherein, recesses are arranged in the step plate at right angles to the path of the webs and grooves.

8. A step element for an escalator or for a moving walkway, wherein the step element is configured as a one-piece die-cast aluminium part, comprising a step element skeleton and a step plate wherein the step plate has a step profile, wherein the step profile has webs and grooves running in the travelling direction, and wherein recesses are arranged in the step plate at right angles to the path of the webs and grooves; and wherein, the bottom of the groove is configured as a radius.

9. The step element according to claim 8 wherein, the recesses are formed the same width or narrower than teeth which are formed from the webs between the recesses.

10. The step element according to claim 8 wherein, the width of the recess corresponds to double the radius of the bottom of the recess.

11. A method for manufacturing a step element according to claim 8 wherein, the step element is made as a one-piece part in the die-casting process.

12. A method for manufacturing a step element according to claim 1 wherein, the step element is made as a one-piece part in the die-casting process.

* * * * *